United States Patent [19]

Hart et al.

[11] 4,153,453

[45] May 8, 1979

[54] COMPOSITE ELECTRODEPOSITS AND ALLOYS

[75] Inventors: Anthony C. Hart, Sedgley; William R. Wearmouth, Halesowen, both of England

[73] Assignee: The International Nickel Company, Inc., New York, N.Y.

[21] Appl. No.: 831,471

[22] Filed: Sep. 8, 1977

Related U.S. Application Data

[63] Continuation-in-part of Ser. No. 662,938, Mar. 1, 1976, abandoned.

[51] Int. Cl.[2] ..... C25D 3/56; C22C 19/03; C22C 19/05; C22C 38/00

[52] U.S. Cl. ..... 75/123 J; 75/123 K; 75/126 R; 75/170; 204/43 T; 204/48; 204/49

[58] Field of Search ..... 75/170, 171, 123 J, 75/123 K, 126 R; 204/37 R, 37 T, 16, 43 T, 48, 49; 427/383 R, 383 C, 383 D

[56] References Cited

U.S. PATENT DOCUMENTS

| | | | |
|---|---|---|---|
| 2,119,487 | 5/1938 | Padowicz | 75/136 |
| 2,119,488 | 5/1938 | Padowicz | 75/136 |
| 2,999,798 | 9/1961 | Eitel et al. | 204/34 |
| 3,057,048 | 10/1962 | Hirakis | 204/49 X |
| 3,061,525 | 10/1962 | Grazen | 204/9 |
| 3,168,457 | 2/1965 | Grazen | 204/212 |
| 3,617,363 | 11/1971 | Metzger et al. | 427/383 R |
| 3,790,454 | 2/1974 | Henderson et al. | 204/49 |

FOREIGN PATENT DOCUMENTS

| | | | |
|---|---|---|---|
| 602098 | 7/1960 | Canada | 204/16 |
| 602099 | 7/1960 | Canada | 204/16 |
| 1042355 | 9/1966 | United Kingdom | 204/41 |
| 1200410 | 7/1970 | United Kingdom | 204/40 |
| 1219813 | 1/1971 | United Kingdom | 427/383 R |
| 1336146 | 11/1973 | United Kingdom | 204/48 |
| 1358538 | 7/1974 | United Kingdom | 204/48 |

OTHER PUBLICATIONS

E. G. Kedward, Cobalt, vol. 3, pp. 53–59 & 66, (1973).

F. A. Lowenheim, "Modern Electroplating," p. 433, 2nd. Edition, (1963).

W. H. Safranek, "The Properties of Electrodeposited Metals and Alloys," p. 315, (1974).

*Primary Examiner*—G. L. Kaplan

*Attorney, Agent, or Firm*—Francis J. Mulligan, Jr.; Ewan C. MacQueen

[57] ABSTRACT

An alloy difficult to produce by conventional electrodeposition techniques is produced by electrodepositing at least one metal selected from the group comprising nickel, up to 50% cobalt, and iron with particles incorporating metal in chemically combined state. The particles contain a reactive element, such as carbon, nitrogen, and boron, and a metallic element, such as chromium, molybdenum, and tungsten. The electrodeposit of the particles in a metal matrix is treated in a reducing atmosphere so that the particles react, releasing at least some of their incorporated metal into the matrix to form the alloy while transferring the reactive element to the reducing atmosphere.

4 Claims, No Drawings

COMPOSITE ELECTRODEPOSITS AND ALLOYS

This invention relates to a process for the production of an alloy.

It is known to codeposit two or more metals on a substrate by electrodeposition either as permanent coatings or as coatings subsequently removed from the substrate, such as electroforms, to form an alloy with or without diffusion heat treatment. However, electrodeposition is subject to electrochemical restrictions which at best limit the alloy composition depositable or make it necessary to use commercially unsatisfactory process conditions and which at worst prevent certain alloys being produced as electroforms or even being produced at all by electrodeposition.

For example, while attempts have been made to produce a nickel-chromium alloy electrodeposit by codepositing nickel and chromium metal, it has not proved possible in this way to produce commercially satisfactory nickel-chromium alloy electrodeposits containing useful amounts of chromium in the nickel matrix. Indeed the deposition processes used in these attempts have suffered from defects which have tended to make the processes themselves unsuitable for commercial usage.

It is an object of the present invention to provide a process of making an electrodeposit of an alloy which is normally difficult to produce by conventional electrodeposition techniques.

Generally speaking, the present invention is a process for producing an alloy comprising: coelectrodepositing a matrix of at least one metal selected from the group consisting of nickel, less than 50% by weight cobalt, and iron, with reactive particles incorporating metal in chemically combined state, said particles are compounds of at least one reactive element selected from the group consisting of carbon, nitrogen, and boron, and of at least one metallic element selected from the group consisting of chromium, molybdenum, and tungsten, thereby providing a composite electrodeposit; and heating said composite electrodeposit to temperatures of from about 1000° C. to about 1400° C. for at least 24 hours in a reducing gas atmosphere to release at least some of said metallic element of said particles from its chemically combined state into said matrix thereby forming said alloy while transferring at least some of said reactive element to said reducing gas atmosphere.

While the process of the invention primarily is intended for the production of alloys which are difficult or even impossible to produce by conventional electrodeposition techniques, it is of course equally applicable to the production of alloys which can readily be produced by conventional electrodeposition techniques. Furthermore, the process of the invention can be used for the formation of alloy permanent coatings on a substrate or for the formation of coatings which are subsequently removed from the substrate, such as electroforms. References throughout this specification to "coatings" are to be taken to include electroforms which have been removed from the substrate upon which they were formed.

The thermally decomposable reactive particles incorporating metal in chemically combined state may be codeposited in conjunction with particles which do not react under the conditions used to make the reactive particles react. In this way, an alloy may be produced containing particles which constitute, for example, a dispersion hardening dispersoid. The reactive particles incorporating metal in chemically combined state may alternatively or additionally to the foregoing non-reactive particles be codeposited with metal particles and/or with coated metal particles, for example, carbide coated metal particles.

Although it has been proposed in the past to electrodeposit coatings made up of particles, incorporating metal in chemically combined state, in a metal matrix to improve the hardness and/or wear resistance of the matrix metal, such proposals have only resulted in the production of a composite coating of particles incorporating metal in chemically combined state in a metal matrix and not an alloy. Alloy production, it is thought, was precluded by the use of: (a) unreactive particles incorporating metal in chemically combined state, or (b) the wrong metal or metals, or (c) the use of process conditions or relative proportions of particles incorporating metal in chemically combined state, and matrix metal, which prevented reaction of the particles. For example, chromium carbide ($Cr_3C_2$) and cobalt have been codeposited to form a Co—$Cr_3C_2$ composite coating with improved initial hardness values, but have not been used to form an alloy.

Preferably the process of the invention is used to codeposit nickel or nickel and up to 50% cobalt with chromium carbide particles to form an electrodeposited nickel-chromium or nickel-cobalt-chromium coating. Advantageously, sufficient chromium carbide particles should be utilized to give at least 13% chromium in the electrodeposited coating. However, when the electrodeposited coating contains both cobalt and chromium carbide particles, less than 50% by weight of the matrix should be cobalt, since more than this amount of cobalt leads to excessively high internal stress which precludes the use of such electrodeposites.

The particles incorporating metal in chemically combined state can be reacted by heating in a reducing atmosphere such as hydrogen for at least 24 hours at temperatures of from about 1000° C. to about 1400° C. The degree of reaction of the particles incorporating metal in chemically combined state may be controlled, for example, by variation of the heat treatment temperature and/or time to allow different desired amounts of metal incorporated in the particles to be released. In this way, different properties may be achieved in the electrodeposited coatings. An advantageous heat treatment is to heat in hydrogen at 1000° C. for 24 hours and air cool. It is preferred to transfer at least 50% of the reactive element from the electrodeposit to the reducing gas atmosphere.

Deposits prepared according to the invention may be applied electrolytically, using any convenient electroplating solution such as a Watts bath or sulfamate solution which may be used for electroforming. Preferably an aqueous electroplating solution should be used, although a non-aqueous solution may be employed where suitable. Whether aqueous or non-aqueous, the solution used in the process according to the present invention may deteriorate with time, and it is recommended that such solutions be used while fresh and/or frequently discarded and replaced with fresh solutions. When an electroform is being prepared by the process according to the invention, the particles incorporating metal in chemically combined state should be reacted, for example, by heating, preferably after the electroform is stripped from the substrate upon which it was formed.

Alloys made according to the invention may be harder or softer in the as-plated condition than an electrodeposited coating of the alloy matrix metal in the as-plated condition, depending upon the particular metal or metals being considered. However, no matter whether the alloy is harder or softer in the as-plated condition than an electrodeposited coating of the matrix metal alone in the as-plated condition, the alloy retains its hardness after or on heating, to a much greater extent than does the coating of the matrix metal alone. Furthermore, such hardness property improvements may be obtained with alloys made according to the invention, without unduly affecting the electroformability of the alloys.

For the purpose of giving those skilled in the art a better understanding of the invention, the following illustrative examples are given:

EXAMPLE I

In this example, chromium carbide was codeposited with nickel or with nickel-cobalt. To this end, 32 millimeter square samples of Type 304 stainless steel sheet (nominal composition 19% chromium, 10% nickel, 2% maximum manganese, 1% maximum silicon, 0.08% maximum carbon, balance iron) were plated electrolytically in a standard nickel plating electrolyte containing in aqueous solution 600 g/l (gram/liter) nickel sulfamate, 10 g/l nickel chloride, 40 g/l boric acid, and various amounts of cobalt sulfamate and chromium carbide additions as set forth in Table I. The chromium carbide particles used had a nominal particle size of 2.5 microns.

The electrodeposited coatings A, B, 1, 2, 3, and 4, of which electrodeposited coatings A and B were outside the invention and electrodeposited coatings 1 to 4 were produced according to the invention, were plated on the stainless steel samples in a mechanically stirred bath at a current density of 4.3 Amperes/sq. decimeter ($A/dm^2$), at a bath temperature of 60° C. and at a bath pH of 4.0. In tests for as-plated internal stress, the nickel electrodeposited coating A did not curl away from the stainless steel sample. This was indicative of low internal stress and also showed that electrodeposited coating A was suitable for electroforming. The nickel-cobalt electrodeposited coating B had a high internal stress as-plated, of 110 $N/mm^2$ as measured on a spiral contractometer, which rendered it unsuitable for electroforming. This high stress value supported the observation that the edges of electrodeposited coating B curled away from the stainless steel sheet sample, which is indicative to one skilled in the art, of high internal stress in the electrodeposited coating. The addition of chromium carbide in the virtually cobalt-free nickel electrodeposited coating 1 and in the nickel-cobalt electrodeposited coatings 2 through 4 produced deposits which did not curl away from the sample which, to one skilled in the art, indicates a low internal stress, rendering the electrodeposit compositions 1 through 4 of the invention suitable for electroforming. This is contrary to the hereinbefore referred to proposed cobalt-chromium carbide codeposition technique which was unsuitable for electroforming due to brittleness generated in the electrodeposit.

TABLE I

| Electro-deposited coating | Cobalt[1] in solution (g/l) | Chromium carbide suspended in electrolyte (g/l) | Cobalt[2] content as plated (wt. %) | Chromium[2] carbide content as plated (wt. %) | Carbon[2] content as plated (wt. %) |
|---|---|---|---|---|---|
| A | 0.03 | 0 | 1 | 0 | 0.003 |
| 1 | 0.03 | 300 | 1 | 23.2 | 3.05 |
| B | 4.1 | 0 | 30 | 0 | 0 |
| 2 | 4.25 | 300 | 19 | 19.1 | 2.55 |
| 3 | 4.2 | 150 | 21.5 | 12.4 | 1.65 |
| 4 | 5.7 | 150 | 22.5 | N.A. | N.A. |

[1]As cobalt sulfamate
[2]Weight percent of total electrodeposited coatings
N.A.—Not Available The electrodeposited coatings 1 and 2 were stripped from the stainless steel samples and analyzed for carbon content to determine the weight percent incorporation of chromium into the nickel matrix of electrodeposited coating 1 and into the nickel-cobalt matrix of electrodeposited coating 2 with the results shown in Table II.

Heating in a reducing atmosphere, hydrogen, introduced a considerable amount of chromium into the matrix and removed carbon from the coatings providing homogenous low-carbon nickel-chromium and nickel-chromium-cobalt. alloys. Heating in a neutral atmosphere, argon, provided some alloying of the matrix with chromium; however, only about half as much chromium was transferred to the matrix and very little carbon was removed from the coatings. The effect of the treatment in a reducing atmosphere is contrary to the hereinbefore referred to, known cobalt-chromium carbide electrodeposit in which on heating there was further carbide formation without introduction of metallic chromium into the cobalt matrix.

TABLE II

| | As-plated | | | After heating in hydrogen for 24 hours at 1000° C. | | | After heating in argon for 24 hours at 1000° C. | | |
|---|---|---|---|---|---|---|---|---|---|
| Electro-deposited coating | Chromium content (wt. %)[1] | Cobalt content (wt. %)[1] | Carbon content (wt. %)[2] | Chromium content (wt. %)[1] | Cobalt content (wt. %)[1] | Carbon content (wt. %)[2] | Chromium content (wt. %)[1] | Cobalt content (wt. %)[1] | Carbon content (wt. %) |
| 1 | 0 | approx. 1.0 | 3.05 | 22 | approx. 1.0 | 0.023 | 11 | approx. 1.0 | 2.26 |
| 2 | 0 | 18–19 | 2.55 | 21 | 18–19 | <0.002 | 13–14 | 18–19 | 0.86 |

[1]Determined by electron probe micro analysis as weight percent of matrix
[2]Determined on a macro sample by combustion and measured as weight percent of total The electrodeposited coatings A, B, 3, and 4 which had been stripped from the stainless steel samples together with the electrodeposited coatings 1 and 2 were tested for hardness as-plated and for hardness after heating in various atmospheres for various times, as shown in Table III. Hardness values in Table III were measured on the Vickers Hardness scale using a 1 kilogram weight.

It can be seen from a consideration of the results in Table III that the nickel electrodeposited coating A had a relatively low hardness as-plated of 249 HV which was not retained on heating. The nickel-cobalt electrodeposited coating B had an as-plated hardness of 405 HV which was considerably greater than that of the electrodeposited coating A showing the beneficial effect of cobalt, but this hardens of 405 HV also was not retained on heating. The hardness values in the as-plated condition of electrodeposited coatings 1 to 4 were very similar to that of the nickel-cobalt electrodeposited coating B and greater than that of the nickel electrodeposited coating A except that the virtually cobalt-free electrodeposited coating 1 had a higher as-plated hardness than that of the nickel-cobalt electrodeposited coating B and a very much higher as-plated hardness than that of the nickel electrodeposited coating A.

TABLE III

| Electro-deposited coating | Hardness as plated (HV) | Hardness after 4 hours at 1000° C. in hydrogen (HV) | Hardness after 24 hours at 1000° C. in hydrogen (HV) | Hardness after 24 hours at 1000° C. in argon (HV) |
|---|---|---|---|---|
| A | 249 | N.A. | 55 | 54 |
| 1 | 445 | N.A. | 223 | 264 |
| B | 405 | 84 | N.A. | N.A. |
| 2 | 397 | N.A. | 215 | 213 |
| 3 | 365 | 160 | N.A. | N.A. |
| 4 | 370 | 162 | 145 | N.A. |

N.A.—Not Available

In general, the amount of cobalt that can be incorporated with nickel in an electrodeposited coating (up to about 50% Co) is limited by the fact that the desirable increase in hardness resulting from increasing the cobalt content is accompanied by an undesirable increase in internal stress as-plated. The apparent reduction of the as-plated internal stress by the cedeposition of chromium carbide should, in a nickel-cobalt electrodeposited coating, allow a greater amount of cobalt to be incorporated before the internal stress is increased, thereby enabling a greater hardness to be achieved at low or zero internal stress.

A further indication of the effect of inert or reducing atmosphere heat treatment on the introduction of chromium into the matrix in electrodeposited coatings 1 to 4 according to the invention was obtained by observing the hardness values when the chromium carbide particles in electrodeposited coatings 1 to 4 were reacted according to the invention by heating in hydrogen or argon for times of 4 and 24 hours at 1000° C. followed by air cooling. The hardness values, and thus the strength and probably the wear resistance, were retained on heating the electrodeposited coatings 1 to 4 to a considerably greater extent than was the case with the nickel electrodeposited coating A and the nickel-cobalt electrodeposited coating B when heated in the same way, as can be seen from the results of Table III.

A comparison of the results for electrodeposited coatings B, 3, 4, and 2 in Tables I, II, and III shows that by increasing the amount of chromium carbide suspended in the electrolyte more chromium carbide was codeposited with nickel-cobalt giving, after heating, a greater degree of retained hardness. As can be seen from the Table II results for the electrodeposited coating 2, this improved retention of hardness on or after heating appears to be an effect of the introduction of metallic chromium into the nickel-cobalt matrix consequent upon reaction of the chromium carbide particles when the electrodeposited coating was heated.

A similar comparison of the results for the electrodeposited coatings A and 1 in Tables I, II, and III shows that codeposition of chromium carbide with nickel gave, after heating to react the chromium carbide particles and introduce metallic chromium into the nickel matrix, a greater degree of retained hardness than was shown by the chromium carbide free nickel electrodeposited coating A. However, when the cobalt-chromium carbide electrodeposit produced according to the hereinafter referred to proposal was heated at temperatures of up to 1000° C., there was an increase in hardness from an as-plated value of 465 HV to a value of 600 HV resulting from further carbide formation without introduction of metallic chromium into the cobalt matrix, instead of the reduction in hardness and alloying effects produced by heating the electrodeposited coatings 1 to 4 according to the present invention.

EXAMPLE II

In this example, electrodeposited coatings 5 to 13, according to the invention, were made and tested in the manner set forth in Example I, with the carbon content results shown in Table IV and with the matrix analysis and hardness results before and after heating shown in Table V.

It can be seen from the results of Table IV that in each case the carbon content of electrodeposited coatings 5 to 13 was reduced from the as-plated value by heating at 1000° C. for 24 hours in hydrogen or to a small extent in argon. In general, heating in hydrogen removed considerably more carbon than heating in argon. As the results of Table V show, as regards heating in hydrogen, reduction in carbon content was associated with a corresponding introduction of metal from the reacted particles into the matrix of the electrodeposited coating together with a corresponding reduction in, but not complete loss of, hardness. As heating in argon in general removed less carbon from the electrodeposited coatings than did heating in hydrogen, heating in argon produced far less reaction of the metal-containing particles and hence less incorporation of metal into the coating matrix than did heating in hydrogen. Nevertheless, the hardness values after heating for 24 hours at 1000° C. in either hydrogen or argon were not exceedingly different.

Comparing the hardness results of the particle-free nickel electrodeposited coating A from Table III with the hardness results for electrodeposited coatings 5, 9, and 11 from Table V, it can be seen that in general introduction of the metal particles into the nickel matrix resulted in a higher as-plated hardness and a greater degree of retained hardness after reaction by heating. A similar effect is generally observable when comparing the hardness results of the particle-free nickel-cobalt electrodeposited coating B from Table III with the hardness results for electrodeposited coatings 6, 10, and 12 from Table V. It would also appear from a comparison of the hardness results of electrodeposited coatings 5, 6, 9, 10, 11, and 12 that the nickel-cobalt matrix benefited to a slightly greater extent from the introduction of the metal-containing particles than did the nickel matrix.

TABLE IV

| Electro-deposited coating | Matrix | Particle addition | Particle content suspended in electrolyte (g/l) | Cobalt in solution (g/l) | Iron in solution (g/l) | % Carbon[1] As-plated | After 24 hours at 1000° C. in hydrogen | After 24 hours at 1000° C. in argon |
|---|---|---|---|---|---|---|---|---|
| 5 | nickel | tungsten/ titanium carbide | 300 | 0.03 | 0 | 1.8 | 0.05 | 1.5 |
| 6 | nickel-cobalt | tungsten/ titanium carbide | 300 | 5.12 | 0 | 2.0 | 0.195 | 1.8 |
| 7 | nickel-iron | chromium carbide | 300 | 0 | 2.0 | 2.9 | N.A. | 0.97 |
| 8 | nickel-iron | chromium carbide | 300 | 0 | 2.0 | 3.4 | 0.78 | N.A. |
| 9 | nickel | tungsten carbide | 300 | 0.03 | 0 | 1.0 | 0.037 | 0.72 |
| 10 | nickel-cobalt | tungsten carbide | 300 | 4.15 | 0 | 0.445 | 0.034 | 0.165 |
| 11 | nickel | molybdenum carbide | 25 | 0.03 | 0 | 0.112 | 0.002 | 0.044 |
| 12 | nickel-cobalt | molybdenum carbide | 25 | 4.02 | 0 | 0.087 | 0.005 | 0.006 |
| 13 | nickel-molybdenum | chromium carbide | 300 | 0 | 0 | 1.9 | 0.027 | N.A. |

[1]Determined on a macro sample by combustion and measured as weight percent of total
N.A.—Not Available

TABLE V

| Electro-deposited coating | Matrix analysis as-plated (wt. %)[1] Cr | Mo | Fe | Ti | W | Hardness as plated (HV) | Matrix analysis after 24 hours at 1000° C. in hydrogen (wt. %)[1] Cr | Mo | Fe | Ti | W | Hardness after 24 hours at 1000° C. in hydrogen (HV) | Hardness after 24 hours at 1000° C. in argon (HV) |
|---|---|---|---|---|---|---|---|---|---|---|---|---|---|
| 5 | 0 | 0 | 0 | 0 | 0 | 521 | 0 | 0 | 0 | 1.5–4 | 4.5 | 198 | 217 |
| 6 | 0 | 0 | 0 | 0 | 0 | 578 | 0 | 0 | 0 | 1–2 | 4.5 | 196 | 21 |
| 7 | N.A. | N.A. | N.A. | N.A. | N.A. | 590 | N.A. | N.A. | N.A. | N.A. | N.A. | N.A. | 333 |
| 8 | 0 | 0 | 20 | 0 | 0 | 590 | 16–17 | 0 | 16 | 0 | 0 | 332 | N.A. |
| 9 | 0 | 0 | 0 | 0 | 0 | 400 | 0 | 0 | 0 | 0 | 8–14 | 132 | 71 |
| 10 | N.A. | N.A. | N.A. | N.A. | N.A. | 395 | N.A. | N.A. | N.A. | N.A. | N.A. | N.A. | N.A. |
| 11 | N.A. | N.A. | N.A. | N.A. | N.A. | 390 | N.A. | N.A. | N.A. | N.A. | N.A. | 76 | 75 |
| 12 | N.A. | N.A. | N.A. | N.A. | N.A. | 548 | N.A. | N.A. | N.A. | N.A. | N.A. | 92 | N.A. |
| 13 | 0 | 10–14 | 0 | 0 | 0 | N.A. | 3 | 6 | 0 | 0 | 0 | N.A. | N.A. |

[1]Balance Ni
N.A.—Not Available

The process of the present invention may be used for coating substrates with an alloy coating, for example, for improved wear or corrosion resistance purposes. To this end, it can be used for coating or electroforming molds and dies such as, for example, aluminum die-casting dies or for coating superheater tubes. The process can also be used for electroforming other components, for example in a nickel-chromium alloy, with improved hardness retention on heating for uses where good high temperature properties and/or good resistance to corrosion properties are required. Further examples of such components are press tools, foundry patterns, printing plates and cylinders, diamond cutting bands, foil, for example for heat insulation or battery usage, mirrors, tape, for example brazing tape or resistance tape, wave guides, heat exchangers, filters, gas turbine parts, such as flame tubes, and blades.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

We claim:

1. A process for producing an alloy comprising: co-electrodepositing a matrix of at least one metal selected from the group consisting of nickel, nickel-cobalt alloys containing less than 50% by weight cobalt, nickel-iron alloys, nickel-molybdenum alloys and iron, with reactive particles incorporating metal in chemically combined state, said particles being compounds of at least one reactive element selected from the group consisting of carbon, nitrogen, and boron, and of at least one metallic element selected from the group consisting of chromium, molybdenum, and tungsten, thereby providing a composite electrodeposit; and heating said composite electrodeposit to temperatures of from about 1000° C. to about 1400° C. in a reducing gas atmosphere capable of taking up carbon, nitrogen or boron from said composite electrodeposit for a time sufficient to release at least 50% of said metallic element of said particles from its chemically combined state into said matrix thereby forming said alloy while transferring an equivalent amount of said reactive element to said atmosphere.

2. A process for producing an alloy comprising: co-electrodepositing a matrix of at least one metal selected from the group consisting of nickel, nickel-cobalt alloys containing less than 50% by weight cobalt, nickel-iron alloys, nickel-molybdenum alloys and iron, with reactive particles incorporating metal in chemically combined state, said particles being compounds of at least one reactive element selected from the group consisting of carbon, nitrogen, and boron, and of at least one metallic element selected from the group consisting of chromium, molybdenum, and tungsten, thereby providing a composite electrodeposit; and heating said composite electrodeposit to temperatures of from about 1000° C. to about 1400° C. in a reducing gas atmosphere capable of taking up carbon, nitrogen or boron from said composite electrodeposit for a time sufficient to release substantially all of said metallic element of said particles from its chemically combined state into said matrix thereby forming said alloy while transferring an equivalent amount of said reactive element to said atmosphere.

3. For producing an alloy as defined in claim 2, wherein said reducing gas atmosphere is a hydrogen containing atmosphere.

4. An alloy produced from an electrodeposit containing: a matrix of at least one metal selected from the group consisting of nickel, nickel-cobalt alloys containing less than 50% by weight cobalt, nickel-iron alloys, nickel-molybdenum alloys and iron; and reactive particles incorporating metal in chemically combined state and being compounds of at least one reactive element selected from the group consisting of carbon, nitrogen, and boron and of at least one metallic element selected from the group consisting of chromium, molybdenum, and tungsten, said alloy being formed by heating said electrodeposit in a reducing gas atmosphere capable of taking up carbon, nitrogen or boron from said reactive particles to temperatures of from about 1000° C. to about 1400° C. for at least 24 hours whereby at least 50% of the metal in said particles is released from its chemically combined state into said matrix.

* * * * *